United States Patent [19]

Terlecky et al.

[11] Patent Number: 4,776,474

[45] Date of Patent: Oct. 11, 1988

[54] RAILROAD CAR COUPLER ARRANGEMENT LIMITING EXCESS LATERAL MOVEMENT OF THE COUPLER SHANK

[75] Inventors: Boris S. Terlecky, Woodridge; Ronald P. Sellberg, Naperville, both of Ill.; Russell G. Altherr, Munster, Ind.

[73] Assignees: AMSTED Industries Incorporated; Trailer Train, both of Chicago, Ill. ; a part interest

[21] Appl. No.: 699,817

[22] Filed: Feb. 8, 1985

[51] Int. Cl.[4] ..... B61G 9/04

[52] U.S. Cl. ..... 213/64; 213/50

[58] Field of Search ..... 213/50, 56, 64, 67 R, 213/69, 62 R

[56] References Cited

U.S. PATENT DOCUMENTS

| | | | |
|---|---|---|---|
| 1,152,041 | 8/1915 | O'Connor | 213/67 R X |
| 1,684,209 | 9/1928 | Whitridge et al. | 213/69 |
| 2,019,311 | 10/1935 | Kinne | 213/67 R |

FOREIGN PATENT DOCUMENTS

| | | | |
|---|---|---|---|
| 66643 | 5/1969 | German Democratic Rep. | 213/64 |

*Primary Examiner*—Robert B. Reeves
*Assistant Examiner*—Scott H. Werny
*Attorney, Agent, or Firm*—Edward J. Brosius; Charles E. Bouton; Robert V. Jambor

[57] ABSTRACT

A railroad car coupler arrangement particularly suited to cars with single axle trucks including means defining a coupler pocket, a coupler head with a coupler shank and a butt end, a draft gear cushioning device in the pocket with a follower plate captured against transverse movement. The butt end and follower plate include interengaged means to restrain the butt end against transverse movement.

13 Claims, 1 Drawing Sheet

C-L
11
13
15
17
19
21
23
25
27
31
33
35
37
39
40
41
43
45
47
49
53
55
57
59
63
65
67
73
75

RAILROAD CAR COUPLER ARRANGEMENT LIMITING EXCESS LATERAL MOVEMENT OF THE COUPLER SHANK

BACKGROUND OF THE INVENTION

This invention relates to railroad couplers. More particularly, it relates to what are called square butt couplers, which are usually of the so-called E type. Couplers of this type are used on cars with conventional trucks and, more recently, on cars with single axle trucks. Examples of cars with single axle trucks are found in application for U.S. Pat., Ser. No. 409,844 filed Aug. 20, 1982, now abandoned; application for U.S. Pat., Ser. No. 597,642 filed Apr. 6, 1984, now U.S. Pat. No. 4,589,558; application for U.S. Pat., Ser. No. 653,821 filed Sept. 24, 1984; and application for U.S. Pat. Ser. No. 653,831, filed Sept. 24, 1984, now U.S. Pat. No. 4,596,311; all of which are owned by the common assignee. The disclosure of these applications are hereby expressly incorporated by reference into this application.

In a conventional square butt coupler, the rear part of the square butt coupler shank has considerable latitude for lateral movement. On cars with single axle trucks, this can result in unfavorable coupler angles with respect to the car center line under certain train operating conditions.

SUMMARY OF THE INVENTION

The present invention encompasses a railroad car couple arrangement which stabilizes and centers the back end of a square butt coupler. It is of particular advantage in reducing the lateral movement of the rear end of the coupler shank of a square butt coupler when it is used in a sill pocket on a car with single axle trucks. The purpose of stabilizing and centering the back end of the square butt coupler is to eliminate unfavorable coupler angle with respect to the car's center line under certain operating conditions, particularly in buff loading.

DETAILED DESCRIPTION

Figures 1, 2, 3, 4:
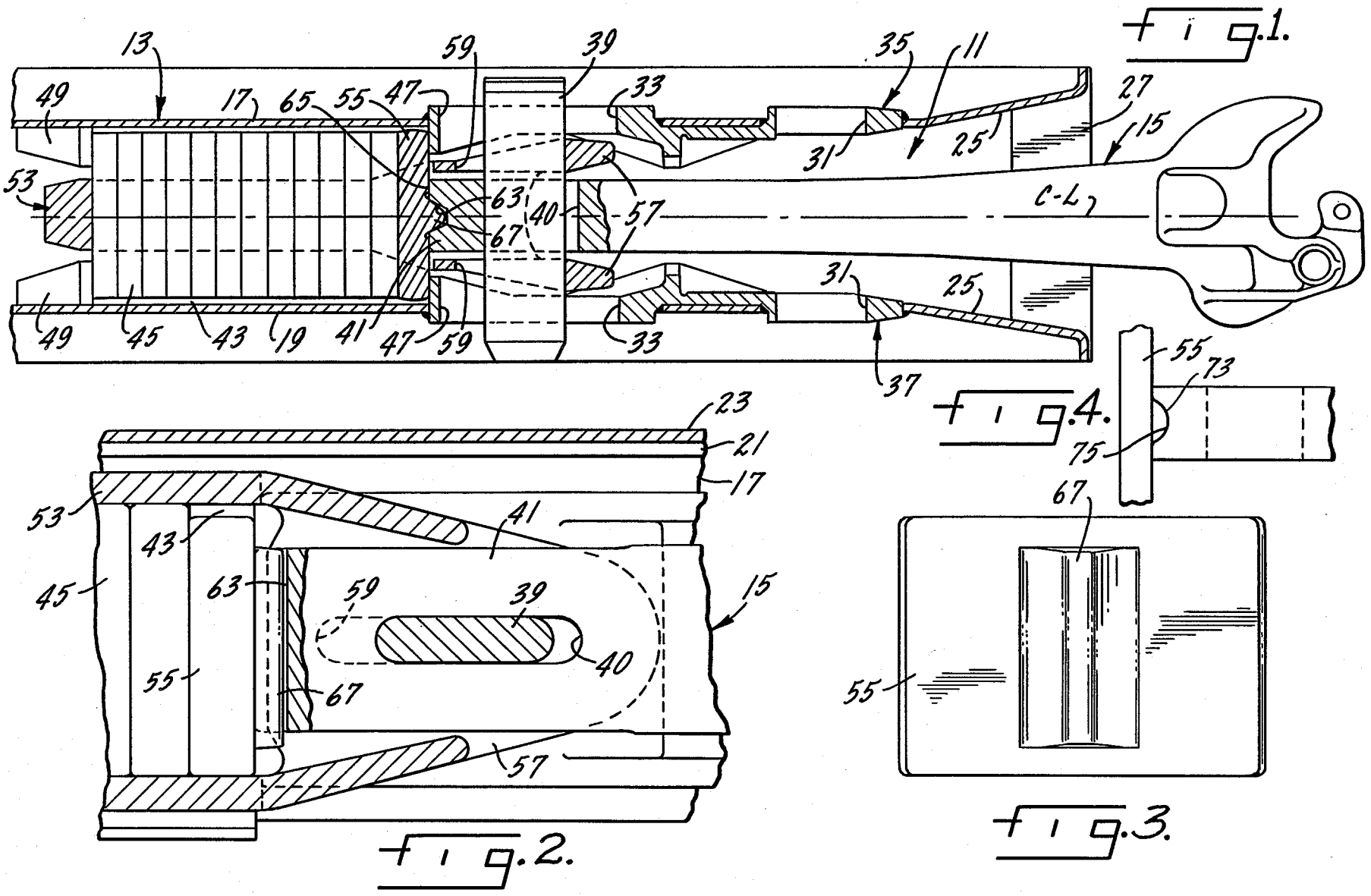
FIG. 1 is a top plan view, partially in section, showing a car coupling arrangement incorporating the features of the present invention.
FIG. 2 is an enlarged, partial, side elevational view of the car coupling arrangement of FIG. 1.
FIG. 3 is an elevational view of the follower block of this invention shown on the same scale as that of FIG. 2.
FIG. 4 is a top plan view of a portion of the apparatus of FIG. 1 showing a modified form of the invention.

Referring now to the drawings, FIG. 1 illustrates a railroad coupler pocket 11 which is formed integrally of the centersill 13 of a railroad car which, of course, is the main structural member of the car. In accordance with the advantages of the present invention, the car includes trucks with single axles, such as the car shown in United States patent applications identified above.

The coupler pocket 11 permits connection of the car using a standard car coupler such as the E-type coupler 15 and also permits the use of semi-permanent drawbar connections when multi-platform cars are connected to each other. Such a coupler pocket is described in U.S. Pat. No. 4,589,558. The inventive concept is equally applicable to a coupler pocket connection which receives only a coupler, and not a drawbar. The advantages obtained, however, are particularly significant to cars with single axle trucks.

As is conventional, the centersill 13 includes a pair of spaced apart vertical plates 17 and 19 welded to a top plate, not shown, to form the channel beam construction of the centersill 13. An access opening 21 is formed in the top plate to provide egress into the coupler pocket 11. A removable cover plate 23 is provided to normally close the access opening 21.

Vertical plates 17 and 19 include portions 25 adjacent the end of the sill which are each disposed at an acute angle to the longitudinal center line of the centersill 13. These portions form a wide mouth 27 which accommodates lateral pivoting of the car coupling member as the car negotiates curves.

Pairs of aligned forward draft key slots 31 and rearward draft key slots 33 are formed respectively in castings 35 and 37 which fit into openings formed in the vertical plates 17 and 19 of the centersill 13. The castings are fastened to the vertical plates by welding in the manner described in said U.S. patent application Ser. No. 597,642, filed Apr. 6, 1984. Forward draft key slots 31 are used for connection of a semi-permanent drawbar connection (not shown) while the rearward draft key slots 33 are used to connect the E-type coupler 15 as shown in FIG. 1 of the drawings of this application using a standard key 39. A standard key retainer (not shown) is used to removably retain the key 39 in position. The standard key 39 extends through a key slot 40 in the coupler shank 41.

A chamber 43 for a draft gear or cushioning device 45 is formed between the vertical plates 17 and 19 of the centersill 13, the rear stops 47 formed on the castings 35 and 37 and the draft gear stop blocks 49 formed on the vertical plates 17 and 19. The rear stops 47 on the castings and the draft gear stop blocks 49 respectively limit forward and rearward movement of the cushioning device 45.

A coupler yoke 53 encircles the cushioning device 45 and a follower plate 55 which is located at the forward end of the cushioning device. The coupler yoke has webs 57 positioned ahead of the follower plate 55 and on opposite sides of the shank 41 of the coupler 13. Key slots 59 are formed in the webs and these align with the key slots 33 in the castings 35 and 37 and the key slot 40 in the shank 41 which together receive the coupler key 39.

In accordance with the principles of this invention, in order to reduce the lateral movement of the rear end of the coupler shank 41, a vertically extending recess 63 is formed in the butt end wall 65 of the coupler shank 41. In this embodiment of the invention, the vertical extending recess 63 is shown as trapezoidal in horizontal cross-section. A somewhat complementary vertically extending projection 67 is formed on the follower plate 55 with this projection designed to mesh in the recess 63. The projection is shown as somewhat trapezoidal in horizontal cross-section and complementary in size to the recess 63 so that it will be received in the recess 63. However, its included angle is smaller than the opening angle of the recess to prevent binding. Also, the recess is deeper than the projection 67. The projection is cast as a part of the follower plate and its cross-sectional configuration is somewhat rounded from a trapezoidal shape to more readily mesh with the trapezoidal recess 63. Relief grooves are formed on opposite sides of the trapezoidal projection 67 at the base thereof. The engagement between the projection 67 of the follower plate 55 with the recess 63 in the butt end wall 65 of the shank 41 limits lateral movement of the shank but allows the shank of the coupler 15 to move vertically without binding.

It should be appreciated that any number of suitable shapes may be utilized for the recess 63 and projection 67. FIG. 4, for example, illustrates a projection 73 with a semi-circular cross-section that is received in a semi-circular recess 75. It should be noted that the recess 63 and projection 67 are formed so as to be disposed along the car centerline designated C-L in FIG. 1 when the coupler and car are in alignment. Follower plate 55 is not susceptible of movement transverse of the longitudinal centerline C-L because it is captured within chamber 43.

With the coupler of this invention, tractive effort to the E-type coupler 15 is transmitted to the car body centersill 13 through the cushioning device 45. In traction, the rearward edge of the coupler shank key slot 40 engages key 39 and pulls it into contact with the forward edges of key slots 59 of the webs 57 of the coupler yoke 53. The yoke 53 compresses the cushioning device 45 against the draft gear follower plate 55 to impart traction forces to the rear stops 47 on the castings 35 and 37. During this traction force, the projection 67 on the follower plate 55 will still be meshed in the recess 63 of the butt end wall 65 of the coupler shank 41 thereby limiting lateral movement of the coupler shank.

In buff loading, the butt end wall 65 of the coupler shank 41 engages the face of draft gear follower plate 55. The follower plate 55 urges the cushioning device 45 towards the stop blocks 49 at the rearward end of the cushioning device chamber 43 and compresses it against these stops. The blocks 49 transmit the buff loading to the centersill 13. During buff loading, the recess 63 of the coupler shank receives the projection 67 of the follower plate to limit lateral movement of the coupler shank.

It will be apparent to those skilled in the art that various additions, substitutions, modifications, and omissions may be made to the construction of the present invention without departing from the scope or spirit of the invention. Thus, it is intended that the present invention cover the addition, substitution, modification and omissions of this invention which come within the permissible scope of the appended claims.

We claim:

1. A railroad coupling arrangement including:
means defining a coupler pocket,
a coupler having a head and a shank,
the coupler shank extending into the coupler pocket and having a butt end having an end wall which is located inside the coupler pocket,
a draft gear cushioning device disposed in said pocket adjacent said butt end and compressible thereby,
said cushioning device having a follower plate defining a wall surface that engages the butt end wall,
said means defining said coupler pocket capturing said follower plate in said pocket to prevent movement of said plate transverse of the longitudinal centerline of said pocket,
one of the engaging walls of the coupler shank butt end and the follower plate having a vertically extending recess and the other of the walls having a complementary vertically extending projection which interfit to limit lateral movement of the coupler shank relative to the coupler pocket transversely of the longitudinal center line of the car, and in which the vertically extending recess and the complementary vertically extending projection are each trapezoidal in cross-section.

2. In a railroad car having a single axle truck, a coupling arrangement including:
means defining a coupler pocket,
a coupler having a head and a shank,
the coupler shank extending into the coupler pocket and having a butt end having an end wall which is located inside the coupler pocket,
a draft gear cushioning device disposed in said pocket adjacent said butt end and compressible thereby,
said cushioning device having a follower plate defining a wall surface that engages the butt end wall,
said means defining said coupler pocket capturing said follower plate in said pocket to prevent movement of said plate transverse of the longitudinal centerline of said pocket,
one of the engaging walls of the coupler shank butt end and the follower plate having a vertically extending recess and the other of the walls having a complementary vertically extending projection which interfit to limit lateral movement of the coupler shank relative to the coupler pocket transversely of the longitudinal centerline of the car, and in which the vertically extending recess and the complementary vertically extending projection are each trapezoidal in cross-section.

3. A railway coupler comprising:
an elongated shank portion in a center sill structure,
said shank portion having a butt end, said butt end having a vertical groove therein, said groove formed by two outwardly angled sides and a front wall joining said sides,
and a follower block of a generally rectangular shape, said follower block having a vertical projection extending from a front face thereof, said projection formed by two angled side walls and a front wall joining said side walls, wherein adjacent surfaces of said follower block projection side walls and said butt end groove sides are angled to about the same angle so as to form complementary surfaces,
said follower block projection adapted to be received in said shank butt end vertical groove to limit the horizontal movement of the shank butt end.

4. The coupler of claim 3 wherein the butt end of the coupler includes an edge face to each side of the groove, said groove being of sufficient depth such that upon said coupler butt edge faces both flushly engaging said follower front face to either side of said projection, no contact occurs between said front wall of said projection and said front wall of said groove.

5. The coupler of claim 3 wherein, upon horizontal angling of said coupler shank or lateral displacement of said butt end in said center sill structure, one of the angled sides of said coupler butt end groove will contact the adjacent angled side wall of said follower projection to limit the maximum displacement of said coupler butt.

6. The coupler of claim 5 wherein said contact occurs prior to an outer edge of the coupler shank contacting an inner surface of said center sill structure.

7. The coupler of claim 5 wherein said contact occurs prior to an outer edge of the coupler shank contacting an inner surface of a yoke within said center sill structure.

8. The coupler of claim 3 wherein a maximum horizontal offset of said coupler butt occurs when one of said shank butt groove sides contacts the adjacent angled side wall of said follower projection, and when a side edge of said follower contacts an inner wall of said center sill.

9. The coupler of claim 3 wherein said butt end groove sides are outwardly angled at the same angle to said rear wall.

10. The coupler of claim 3 wherein said follower block projection side walls are outwardly angled at the same angle to said front wall.

11. A railway coupler comprising:

an elongated shank received in a center sill structure, said shank having a butt end portion with an end face having a vertical cutout portion, said vertical cutout portion formed by two angled sides joined by a forward wall, with sections of the end face to either side of said vertical cutout portion forming end face walls, and a follower received in a yoke in said center sill structure adjacent the butt end of said shank, said follower comprising a generally rectangular, planar element having a raised projection extending along the vertical axis of one face of said follower, said projection formed by two side edges joined by a front wall, wherein adjacent surfaces of said follower projection side edges and said shank butt cutout angled sides are angled at about the same angle to form complementary surfaces, said follower projection adapted to be received in said shank butt cutout portion to limit the horizontal movement of the shank butt in the center sill structure.

12. The coupler of claim 11 wherein the maximum horizontal movement of the shank butt in the center sill structure is limited by the contact of one of the angled sides of the cutout portion of the shank butt with one of the side edges of the follower projection and the contact of an edge of said follower with a sidewall of said center sill.

13. The coupler of claim 11 wherein the relative height of the projection outward from the follower is less than the depth of the cutout in the shank butt so that, upon flush contact of the end face walls of the shank butt with the one face of the follower, the front wall of the follower projection does not contact the forward wall of the cutout portion of the shank butt.

* * * * *